US010154721B2

(12) United States Patent
Friedl et al.

(10) Patent No.: US 10,154,721 B2
(45) Date of Patent: Dec. 18, 2018

(54) ARTWORK POCKET FOR CHILD'S BACKPACK

(71) Applicants: Kelly Friedl, Chicago, IL (US); Eric Eichhorn, Beachwood, OH (US)

(72) Inventors: Kelly Friedl, Chicago, IL (US); Eric Eichhorn, Beachwood, OH (US)

(73) Assignee: Urban Infant, Chicago, IL (US)

( * ) Notice: Subject to any disclaimer, the term of this patent is extended or adjusted under 35 U.S.C. 154(b) by 0 days.

(21) Appl. No.: 15/688,359

(22) Filed: Aug. 28, 2017

(65) Prior Publication Data

US 2018/0125209 A1 May 10, 2018

Related U.S. Application Data

(63) Continuation of application No. 14/807,713, filed on Jul. 23, 2015.

(60) Provisional application No. 62/118,964, filed on Feb. 20, 2015.

(51) Int. Cl.
*A45F 3/04* (2006.01)

(52) U.S. Cl.
CPC ..... *A45F 3/042* (2013.01); *A45F 2200/0566* (2013.01)

(58) Field of Classification Search
CPC ..... A45F 2200/0566; A45F 3/042
See application file for complete search history.

(56) References Cited

U.S. PATENT DOCUMENTS

| | | | | |
|---|---|---|---|---|
| 922,567 | A * | 5/1909 | Cosgrove | A45C 7/0045 190/102 |
| 4,574,504 | A | 3/1986 | Holmer | B65D 59/04 206/225 |
| 5,018,609 | A | 5/1991 | Brenner | A45C 11/26 190/108 |
| 5,161,656 | A | 11/1992 | Brenner | A45C 3/00 150/117 |
| 5,680,973 | A | 10/1997 | Vulpitta | A45C 9/00 108/43 |
| 5,961,017 | A * | 10/1999 | Mehler | A45C 7/009 224/153 |
| 6,354,477 | B1 | 3/2002 | Trummer | A45C 3/02 224/153 |
| 6,367,674 | B1 * | 4/2002 | Tabor | A45F 3/04 224/153 |
| 8,397,965 | B2 * | 3/2013 | Eberle | A45F 3/04 224/637 |
| 2005/0218171 | A1 * | 10/2005 | Bellerive | A45C 5/143 224/576 |
| 2011/0114688 | A1 * | 5/2011 | Peng | A45C 5/02 224/600 |

(Continued)

*Primary Examiner* — Derek Battisti
(74) *Attorney, Agent, or Firm* — Clifford H. Kraft

(57) ABSTRACT

An external or internal artwork tube pocket that allows a child to carry artwork on a backpack or other carrying accessory without damage. The invention typically includes a tubular pocket that is open on the top and closed on the bottom. This tube can hold rolled-up sheets of artwork or other paper or thin cardboard. The tube is adapted to be attached to the backpack or accessory. The tube can have a fixed or removable bottom and an optional removable top. A preferred embodiment includes a substantially cylindrical artwork pocket attached vertically to the side of the backpack.

6 Claims, 8 Drawing Sheets

(56) References Cited

U.S. PATENT DOCUMENTS

| | | | | |
|---|---|---|---|---|
| 2012/0286012 | A1 | 11/2012 | Flis | A45F 5/021 224/665 |
| 2013/0075438 | A1 | 3/2013 | Christy | A45F 3/042 224/644 |
| 2013/0082077 | A1 | 4/2013 | Millman | A45F 4/02 224/153 |
| 2014/0291182 | A1 | 10/2014 | Cascio | A45F 5/02 206/389 |
| 2014/0339263 | A1 | 11/2014 | Schumacher | B65D 83/388 222/175 |
| 2014/0346821 | A1* | 11/2014 | Flis | A45F 5/021 297/188.04 |
| 2015/0320183 | A1* | 11/2015 | Donahue | A45F 3/04 224/600 |

* cited by examiner

ARTWORK POCKET FOR CHILD'S BACKPACK

This is a continuation of application Ser. No. 14/807,713 filed Jul. 23, 2015 which claimed priority from provisional application 62/118,964 filed Feb. 20, 2015. Application Ser. No. 14/807,713 and 62/118,964 are hereby incorporated by reference in their entireties.

BACKGROUND

Field of the Invention

The present invention relates generally to children's backpacks or other portable carrying accessories and more particularly to a special pocket for a child's backpack or the like to carry artwork or other papers.

Description of the Prior Art

Children's backpacks, baggage, handbags and other carrying accessories are known in the art. A typical child's backpack resembles that of an adult with a cover that opens and a central bag-like space that can contain objects or papers. Children typically use a backpack to carry books, lunch, pens/pencils, notebooks and other learning and drawing materials.

It is well-known that children like to draw and produce various artwork both at home and at school using pencils, crayons, water paint, marker pens and any other type of black/white or colored writing or drawing device. Such drawing is encouraged in pre-school, kindergarten and other school grades.

The disadvantage of prior art child's backpacks and other carrying accessories is that they are not designed to carry and maintain flat artwork or flat pages that should not be bent. If a child puts a piece of artwork in a prior art backpack (to take it to show their parents for example), it becomes wrinkled and degraded in the pack, especially if the pack contains books or other objects. It would be advantageous to have a child's backpack or other carrying accessory that allows flat artwork to be carried without damage.

SUMMARY OF THE INVENTION

The present invention relates to an external or internal artwork tube pocket that allows a child to carry artwork on a backpack or other carrying accessory without damage. The invention typically includes a tubular pocket that is open on the top and closed on the bottom. This tube can hold rolled-up sheets of artwork or other paper or thin cardboard. The tube is adapted to be attached to the backpack or accessory. The tube can have a fixed or removable bottom and an optional removable top. A preferred embodiment includes a substantially cylindrical artwork pocket attached vertically to the side of the backpack.

DESCRIPTION OF THE FIGURES

Attention is now directed to several drawings that illustrate features of the present invention.

Several drawings and illustrations have been presented to aid in understanding the present invention. The scope of the present invention is not limited to what is shown in the figures.

DETAILED DESCRIPTION OF THE PREFERRED EMBODIMENTS

The present invention relates to a tubular or other-shaped pocket attachable to any type of carrying accessory. While the invention is primarily directed toward children's backpacks and accessories, it can be used with any backpack, bag, purse, luggage or other carrying accessory for any person of any age.

Figure 1:
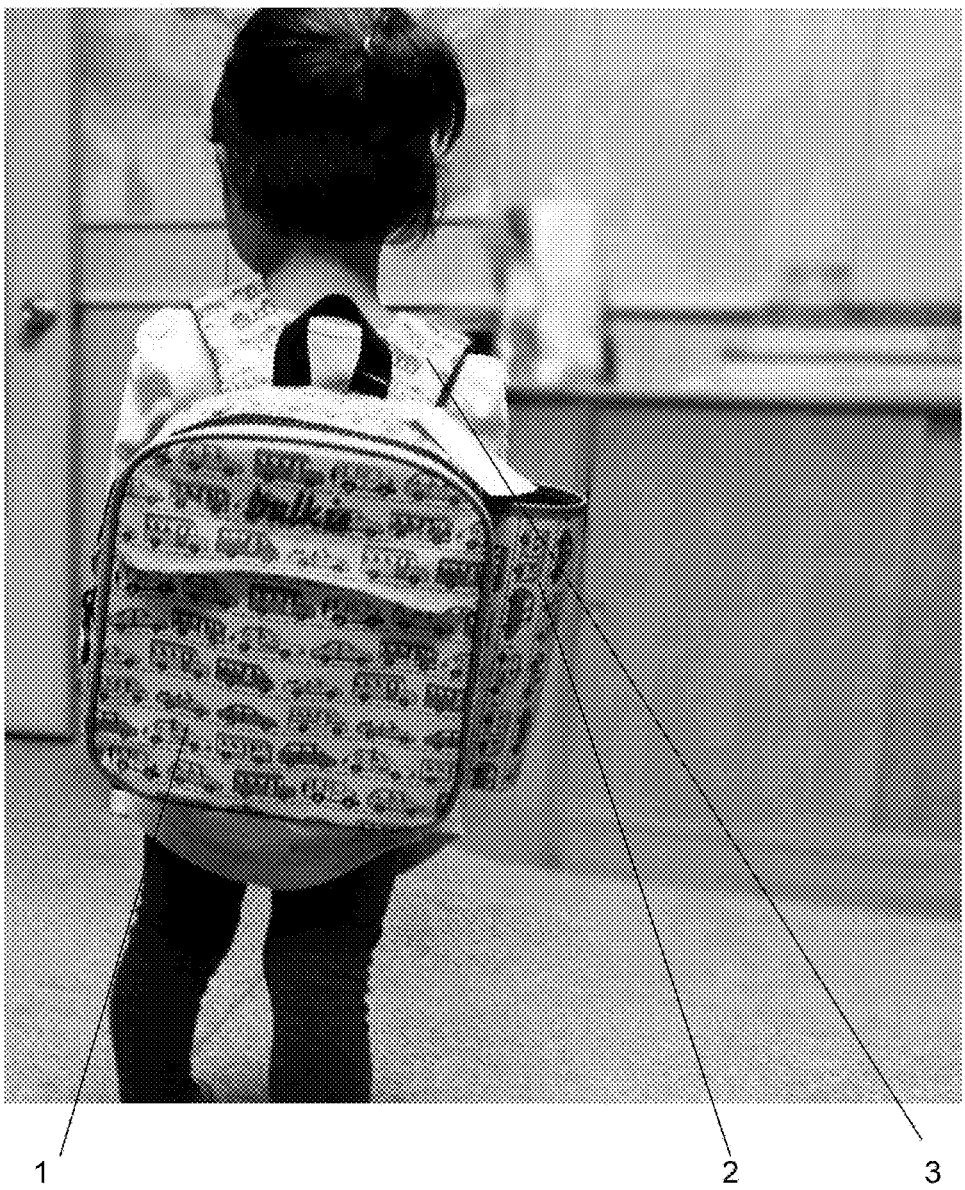
FIG. 1 shows a child wearing an embodiment of the present invention.

FIG. 1 shows a child wearing an embodiment of the present invention. An elongated pocket 2 is sewed or otherwise attached to a backpack 1 or other accessory. The backpack 1 has straps 3 for wearing as is known in the art.

Figure 2:
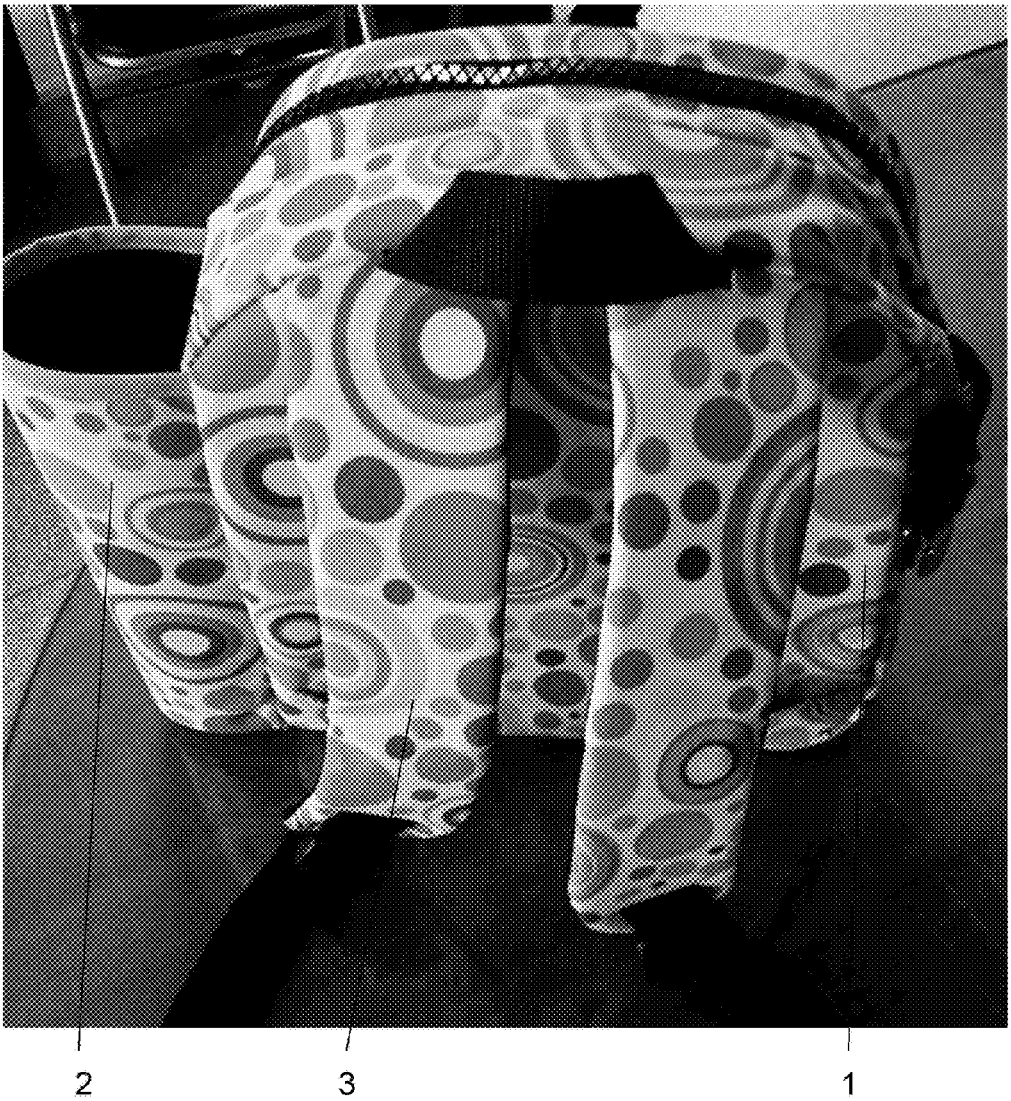
FIG. 2 shows a back view of an embodiment.

FIG. 2 shows the tubular pocket on the left side of the backpack in a similar embodiment to that of FIG. 1. While a vertically mounted tube of substantially cylindrical (or U-shaped) cross-section is preferred, the shape or cross-section of the pocket or tube is not so limited and can be round, square, rectangular, triangular or have any other shape or cross-section. Its diameter or largest radial dimension can take any value from around 1 inch to 3-5 inches or larger. Its length can take any value with the preferred length approximating the height either of the entire accessory or of part of it. In the embodiment of FIG. 2, the pocket 2 extends from the bottom of the backpack 1 up to the lower part of the curved pack top. The pocket can be made of the same material or pattern as the accessory or it can be different. It is preferred to use the same material to achieve a uniform and esthetically pleasing design.

Figure 3:
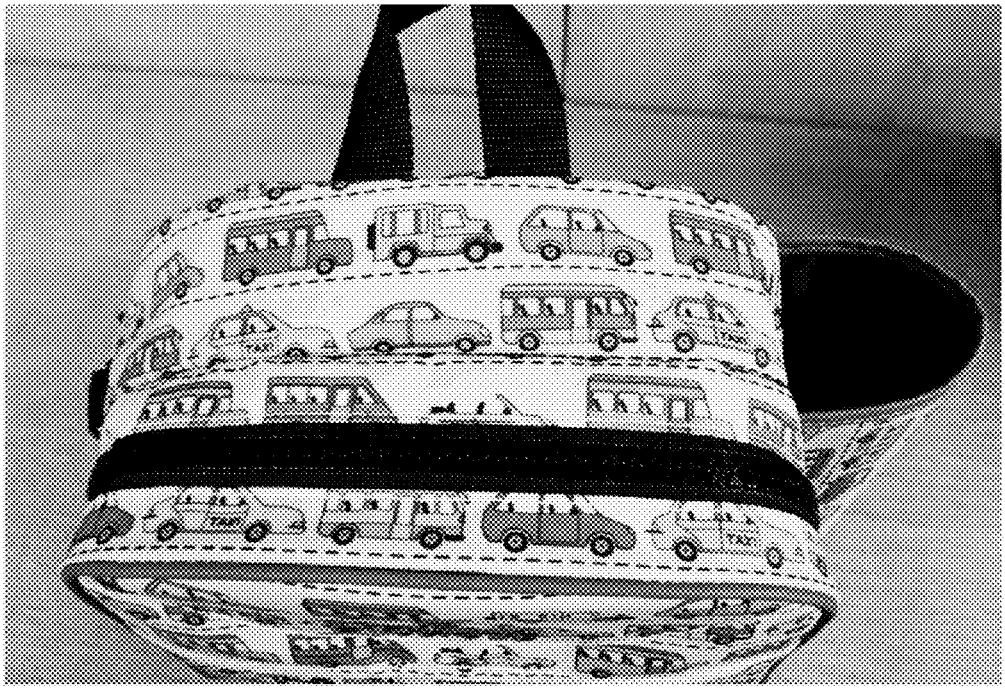
FIG. 3 is a top view looking down on an embodiment similar to that of FIG. 2.

FIG. 3 is a top-down view of an embodiment of the invention where the material of the pocket has the same design, look and feel as the body of the pack.

Figure 4:
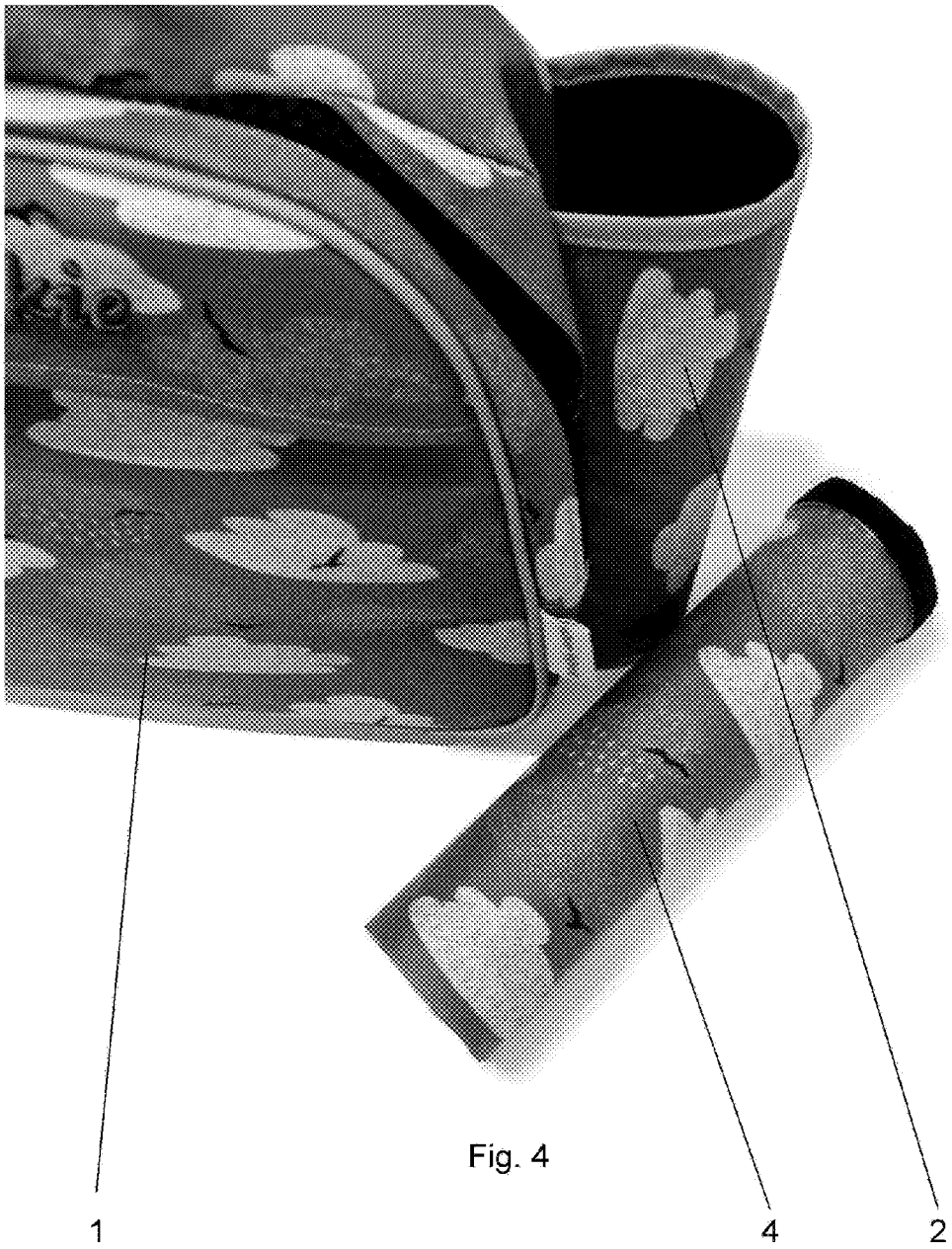
FIG. 4 shows a close view of an embodiment that allows a tube insert.

In a different embodiment of the invention, an inner artwork tube or silo 4 can fit into the accessory pocket 2 as shown in FIG. 4. Artwork can be placed in the inner tube 4, and that tube 4 can be inserted in the pocket 2. The pocket 2 can be large enough to receive the inner tube 4 and also other additional tubes or accessories. For example, pencils or pens can be placed in a smaller diameter tube (not shown) that could be inserted in the pocket 2 with the artwork tube or separately.

Figure 5:
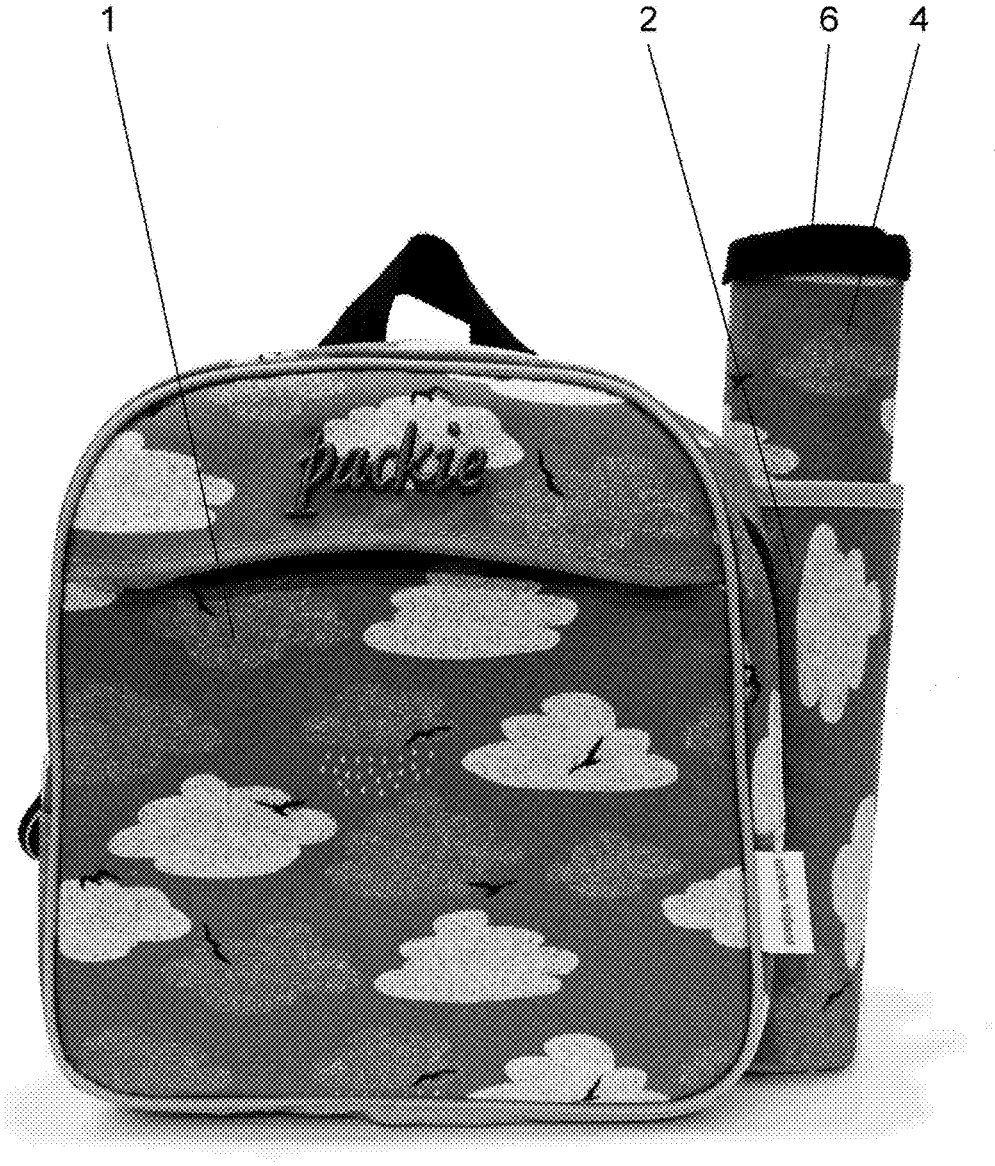
FIG. 5 shows the embodiment of FIG. 4 with the tube inserted.
Figure 6:
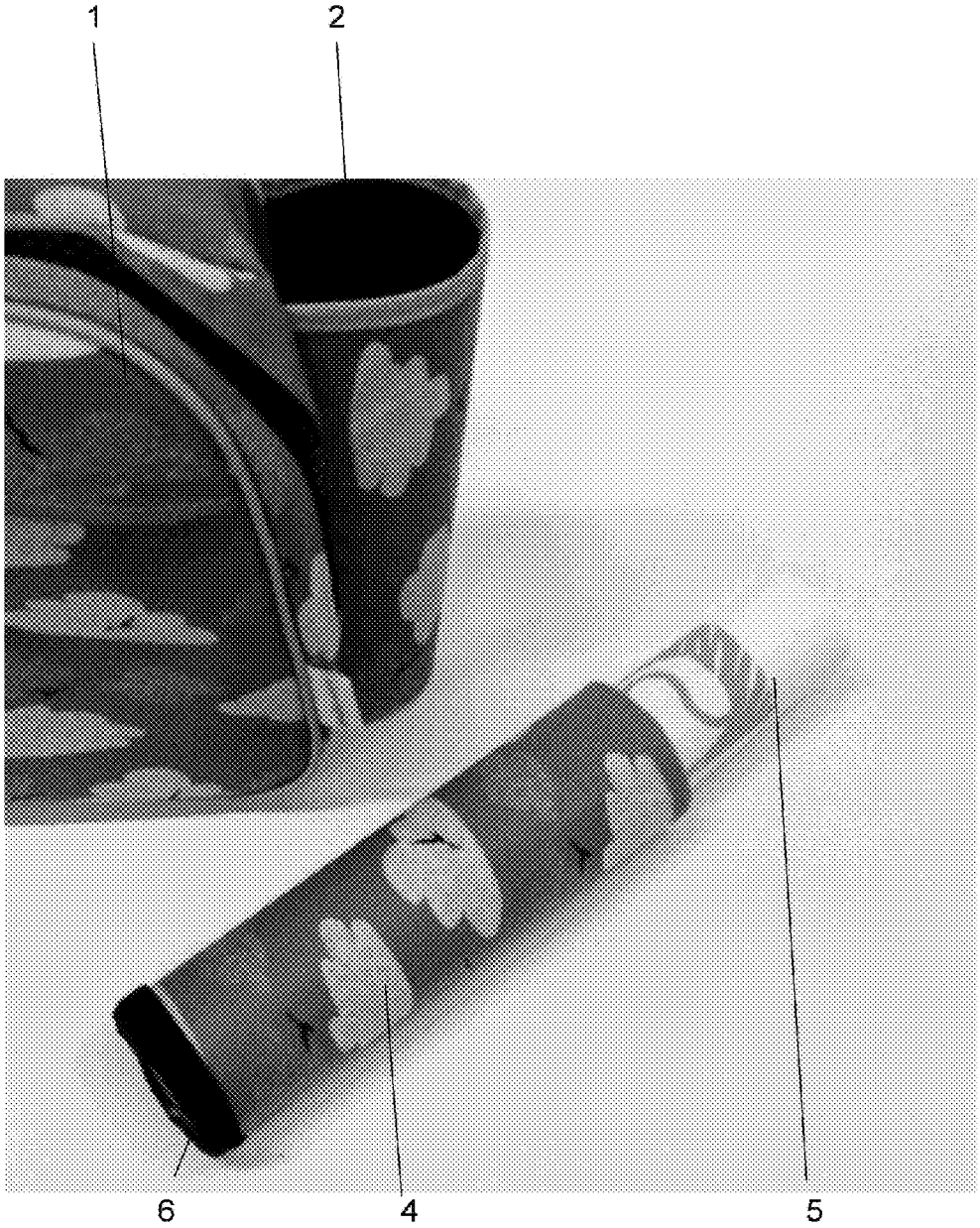
FIG. 6 shows the tube with a drawing extending outward.
Figure 7:
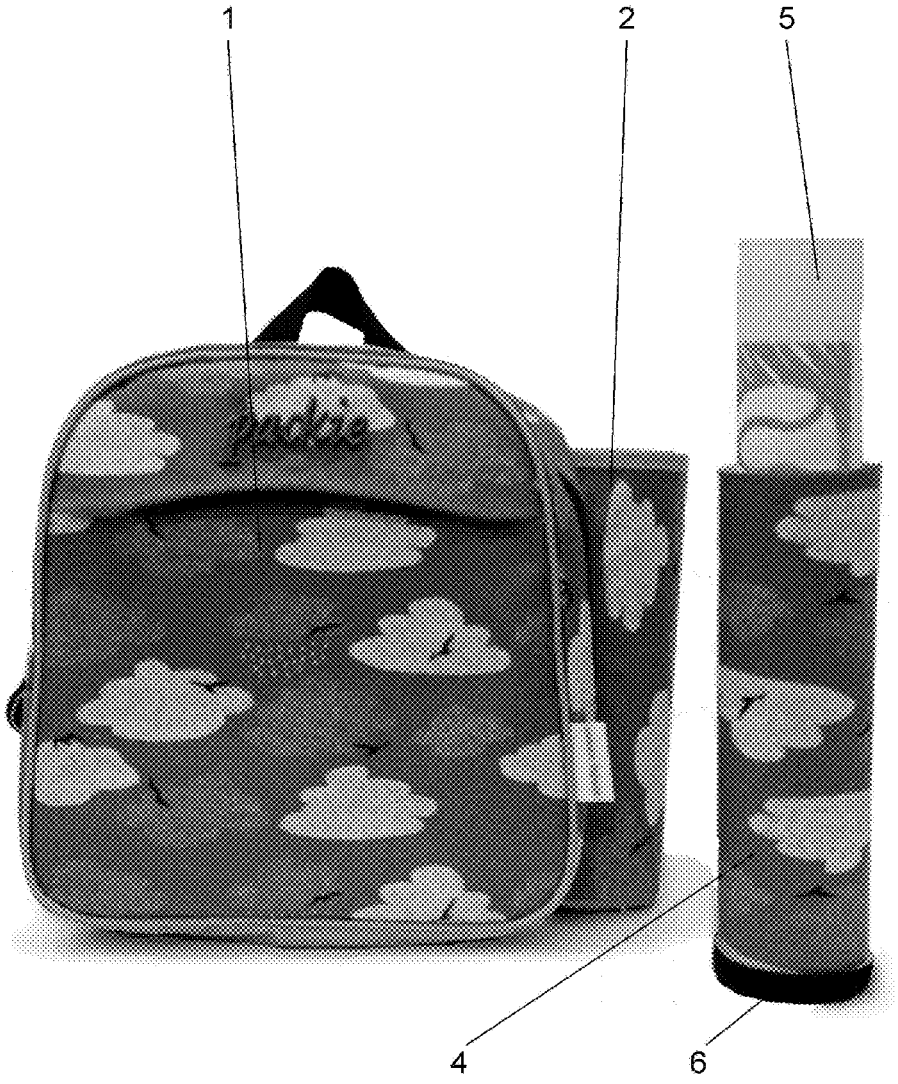
FIG. 7 shows the tube with a drawing standing next to an embodiment of FIG. 4-5.

FIG. 5 shows the tube 4 having a cap 6 inserted in the pocket 2. The cap 6 is optional. FIG. 6 shows artwork 5 rolled up and inserted into the tube 4. As previously described, the tube 4 can then be inserted into the attached pocket 2 as shown in FIG. 7.

The present invention provides an easy way for a child to carry rolled artwork and the like to and from school, church, pre-school or wherever the child is going. The pocket has been shown mounted on the side of a backpack. While this is the preferred mounting arrangement, the pocket can be mounted anywhere in any orientation. The preferred accessory as shown in the figures is a backpack; however, the scope of the present invention is not limited to backpacks or to children's accessories, but rather can be used with any bag, baggage, purse, tote or any other carrying accessory usable by any person of any age. In fact, embodiments of the invention can be used by art students, architects, engineers and others that need a convenient way to carry roll-up papers, artwork, drawings, photographs, plans, graphs and the like.

The accessory, pocket and/or silo can be made of the same material or different material and can be flexible or rigid. In particular, the pocket may be a plastic or other rigid tube in some embodiments. The cross-section of the pocket and/or silo can be substantially cylindrical, U-shaped, square, rectangular, triangular, polygonal of any number of sides, or any other shape or cross-section. The design and surface texture of the pocket and/or silo can be the same as that of the accessory or it can be different. Any design combination and surface texturing is within the scope of the present invention.

Figure 8:
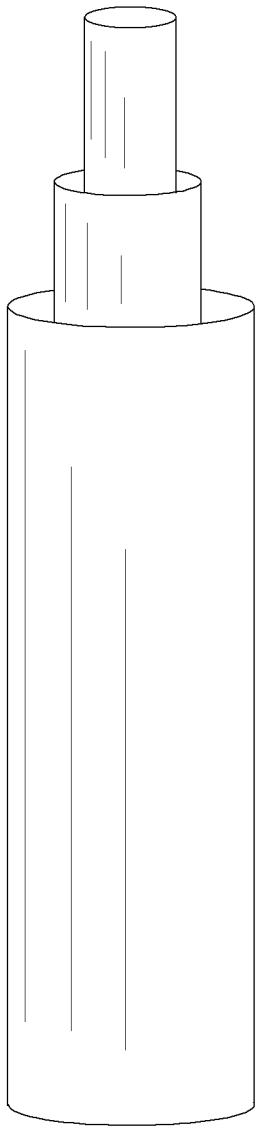
FIG. 8 shows telescopoing non-attached tubes of different sizes.

The invention can be supplied with several different silos 4 for different purposes. For example, a small diameter silo can carry pencils and/or pens, while a larger diameter silo can carry artwork or other rolled papers. FIG. 8 shows three non-attached tubular members of different diameters. These can be put into the a tube insert separately or telescoped.

While the embodiments shown in the figures have an open pocket, it is within the scope of the present invention to have a closed pocket or a lid on the pocket to prevent rain or snow from entering while preventing the artwork from falling out. This lid can have an optional zipper, hook/loop (VELCRO™) or any other type of fastening. The pocket itself is preferably sewed or otherwise permanently attached to the accessory to prevent it becoming lost; however, this is optional. Some embodiments of the invention have removable pockets that attach with a zipper, buttons, fasteners, hook/loop material or by any other removable technique. Any permanent or removable attachment technique is within the scope of the present invention.

While the preferred method is to mount or attach the artwork pocket on the outside of the backpack or accessory, it is also possible to mount or attach it inside the backpack or accessory. This provides additional protection for the artwork.

Several descriptions and illustrations have been presented to aid in understanding the present invention The scope of the present invention is not limited to what is shown in the figures. One with skill in the art will realize that numerous changes and variations are possible without departing from the spirit of the invention. Each of these changes and variations is within the scope of the present invention.

We claim:

1. A method of providing a child's backpack adapted to carry rolled artwork comprising:

providing a backpack body having two sides, a front and a back, and at least one closable compartment between the front and back and between the two sides; the backpack also having shoulder straps;

providing an elongated pocket of substantially cylindrical cross-section attached vertically along one of said sides, the elongated pocket having an open top and a closed bottom;

providing a plurality of non-attached removable tubes of different sizes from one-another, each having a diameter smaller than the diameter of the elongated pocket; the removable tubes having a closed bottom and a removable cap; the removable tubes constructed to hold rolled artwork or other papers or writing instruments, wherein, the removable tubes are configured to be placed in the elongated pocket when the backpack is worn.

2. The method of claim 1 wherein the elongated pocket has a cover configured to be opened and closed.

3. The method of claim 1 wherein the elongated pocket has an exterior design pattern that matches a similar design pattern on the backpack.

4. The method of claim 1 wherein at least one of the tubes has a cylindrical cross-section.

5. The method of claim 1 wherein the pocket has an exterior design pattern that matches a similar design pattern on the accessory.

6. The method of claim 1 wherein said plurality of tubes is two or three tubes.

* * * * *